United States Patent [19]

Yamada

[11] Patent Number: 4,538,444

[45] Date of Patent: Sep. 3, 1985

[54] FRAME STRAIGHTENING DEVICE

[76] Inventor: Steve Yamada, 1022 Brimely Rd., Scarborough, Ontario, Canada, M1P 3E9

[21] Appl. No.: 651,159

[22] Filed: Sep. 17, 1984

[51] Int. Cl.[3] ..... B21D 1/14

[52] U.S. Cl. ..... 72/447; 72/705

[58] Field of Search ..... 72/705, 447

[56] References Cited

U.S. PATENT DOCUMENTS

| | | | |
|---|---|---|---|
| 2,008,929 | 7/1935 | Scherer | 72/705 |
| 2,442,425 | 6/1948 | Merrill et al. | 72/705 |
| 2,692,002 | 10/1954 | Merrill et al. | 72/705 |
| 4,281,532 | 8/1981 | Covington | 72/705 |

*Primary Examiner*—Lowell A. Larson

[57] ABSTRACT

The present invention provides a structure for use in automotive collision repair comprising a support frame of peripheral support beams and at least one work beam extending across and moveable transversely of the peripheral support beams. The work beam is slideably mounted at one end to one of the support beams with the other end of the work beam being slideably supported at an opposing support beam. The work beam is additionally adjustable to different working angles relative to the support beams. The structure further includes a work beam adjustment for adjusting movement of the work beam with the work beam adjustment also being mounted on the one support beam in a manner such that the work beam adjustment is correspondingly slideable and moveable to the different working angles.

20 Claims, 15 Drawing Figures

FIG. 2.
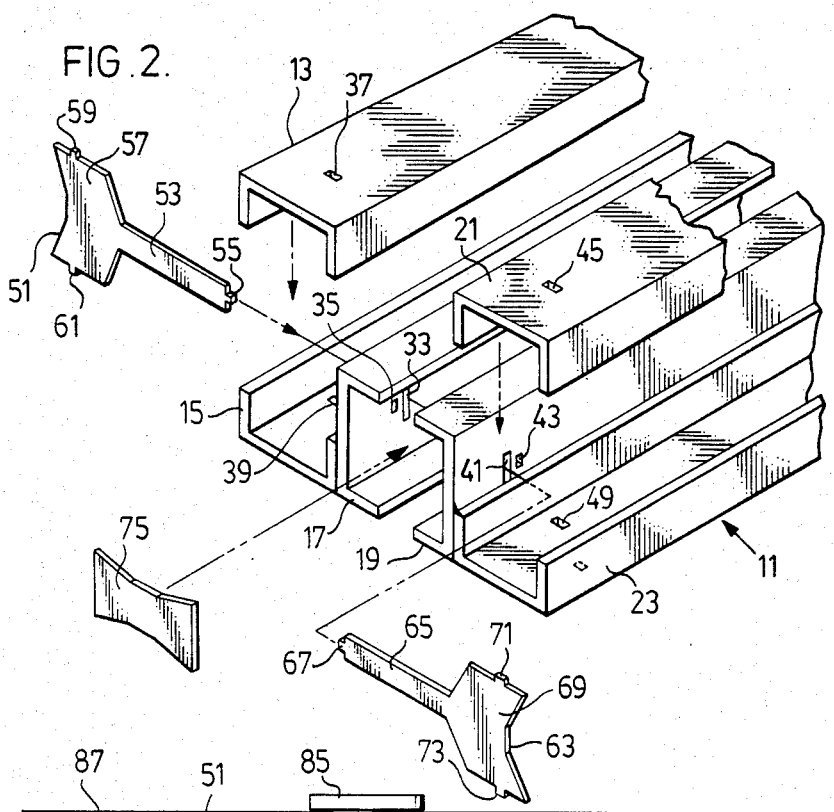
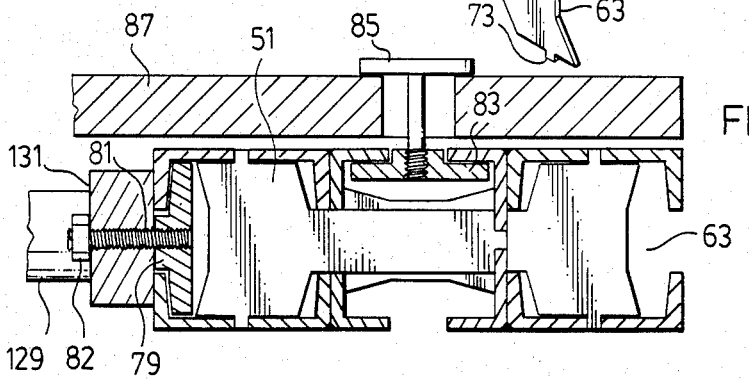
FIG. 3.
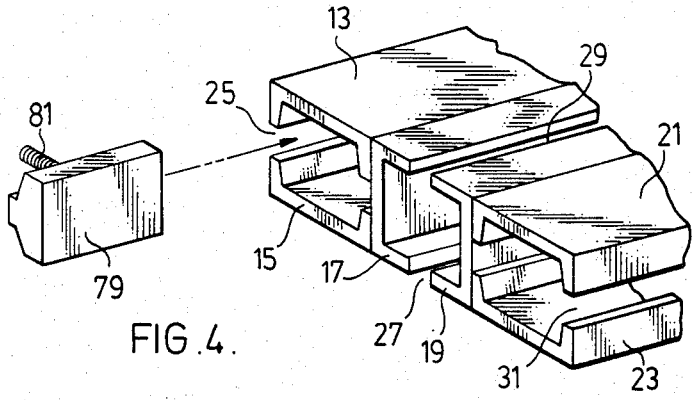
FIG. 4.

FIG. 4a.
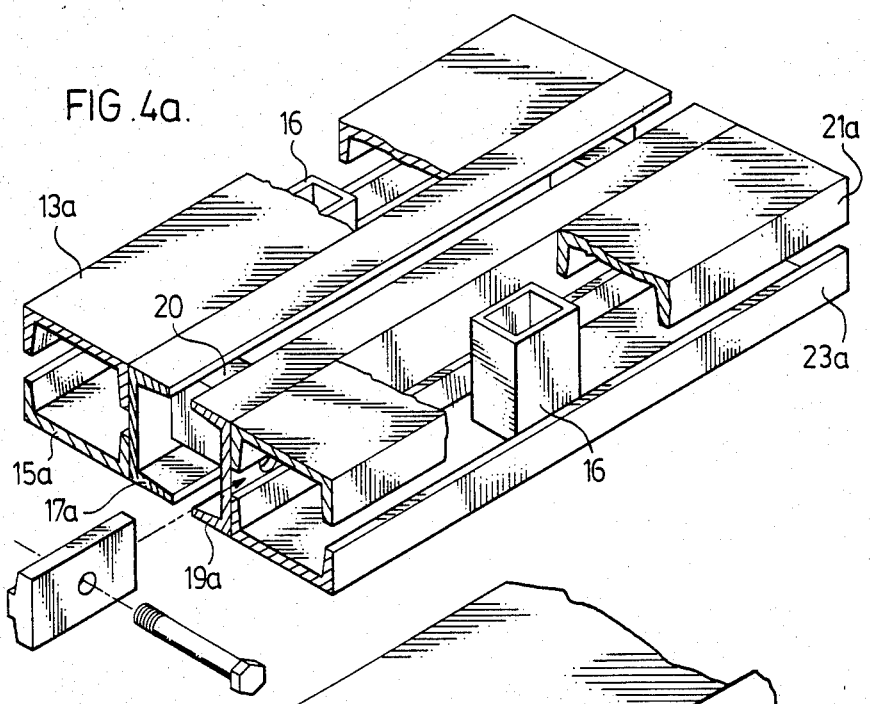
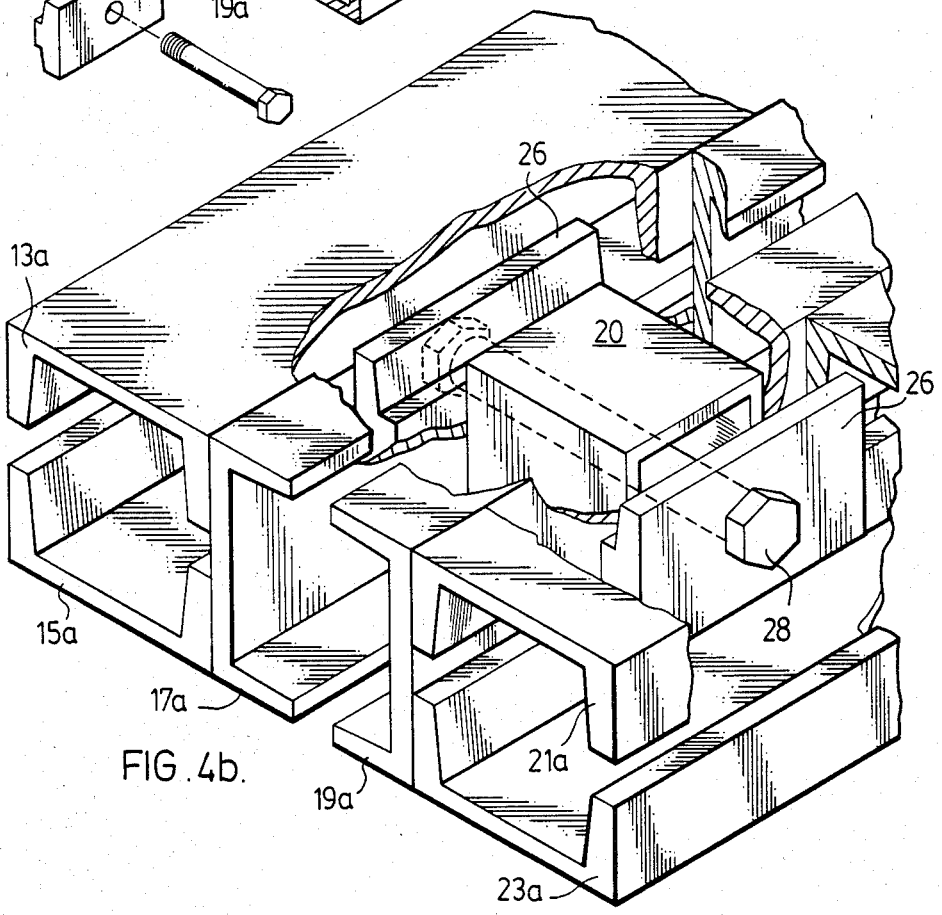
FIG. 4b.

FIG. 9.
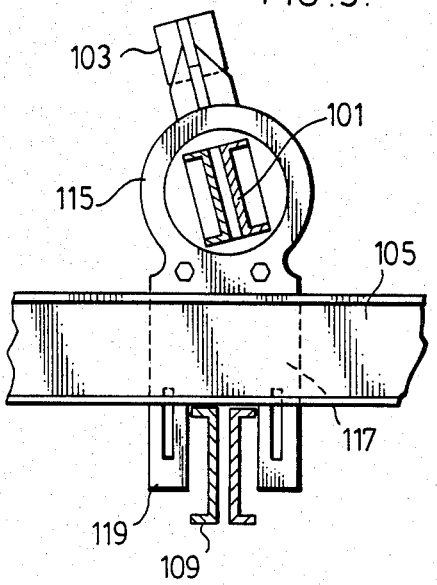
FIG. 10
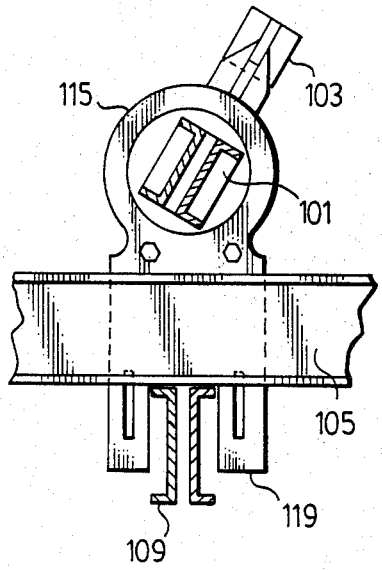
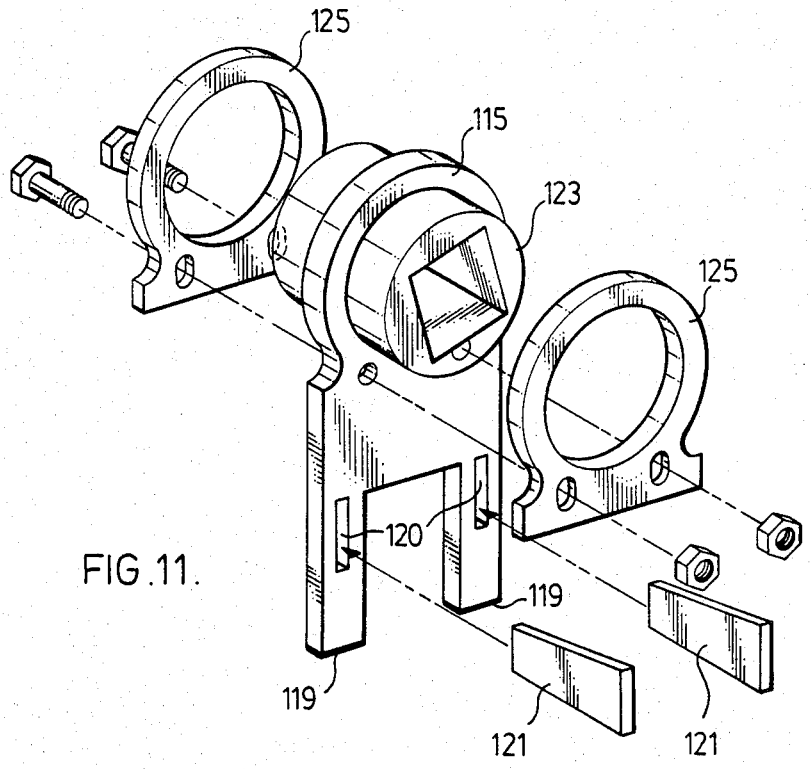
FIG. 11.

FRAME STRAIGHTENING DEVICE

FIELD OF THE INVENTION

The present invention relates to a structure for use in automotive collision repair for straightening both frame and body repair damage. The structure includes work beams which are slideable along the supporting frame of the structure and which are adjustable to different working angles.

BACKGROUND OF THE INVENTION

Conventional rack-type straighteners for use in automotive collision repair and having working beams at or near 90 degrees to the perimeter beams are generally acceptable for use in repairing older cars with heavy, thick frames. The vectoring of these 90 degree beams has been relatively simple for purposes of achieving a diagonal repair since the corrective forces are centered separately from one another and do not tend to create distortion or damage on these older vehicles; however, in accordance with up-dated construction techniques, the newer unibody cars are built in a much lighter manner with 14, 16 and 18 gauge steel rails and the use of this conventional rack-type straightener when hooked up to these newer unibody cars may well in fact result in more damage rather than repairing the already present damage.

The newer small car designs also present interference problems with respect to the location of the work beams due to the closeness of the chassis beams on the vehicle.

There are conventional straighteners in which work beams can be diagonally positioned across the straightener and locked in that diagonal positon for use in repairing damage requiring diagonal pressure closer to the outer boundary of the vehicle. With these arrangements, a tower and pull-jack is installed to pull the damage outwardly, however, to extend this diagonal pull beneath the chassis area requires difficult hook-ups which, in many instances, are prone to accidents because the tower arm axis is never in line with the direction of the pull so that the tower has a tendency to lean. In order to counter this lean the perimeter bed must be additionally reinforced making the bed extremely thick and wide, further hampering access to the vehicle.

One example of a straightener, as described immediately above, is shown in U.S. Pat. No. 4,281,532, issued Aug. 4, 1981 to Covington. Here it will be seen that the cross beams can be moved to different angled positions and once in position must be locked, relative to the main support frame. A tower, as described above, is then used to provide diagonal pressure across the beams for effecting certain repair jobs.

As will be appreciated from the Covington patent, many different locking positions for the work beams must be provided to assure the beam can be moved to an accurate position. Furthermore, the Covington structure is extremely congested with parts such as the locking pins being relatively inaccessible, making it awkward to change positions for any of the transverse beams. The straightener of this patent is relatively inflexible and difficult for use in different types of hook-ups. A further drawback of the Covington structure lies in the hydraulic jacks that must be used to control reciprocal movement of the work beams with each of these hydraulic jacks being permanently located in position. Therefore, a hydraulic jack must be provided for each position to which the work beam is to be moved, otherwise the work beam cannot be moved under force of the piston across the frame of the straightener device.

SUMMARY OF THE PRESENT INVENTION

The present invention provides an automotive collision repair structure specifically designed to mitigate the problems described above. The structure of the present invention is one which is versatile with the capacity to gain access to essentially any damaged region requiring repair without being extremely complex and overloaded with excessive work beams.

More specifically, the automotive collision repair structure of the present invention comprises a support frame of peripheral support members with at least one work beam extending across and moveable transversely of opposing ones of the support members for working on different damaged repair regions. The structure further includes work beam mounting means for mounting one end of the work beam to one of the support members with the other end of the work beam being supported at the opposing support member such that the entire work beam is slideable relative to the support frame of the structure and adjustable to different working angles relative to the support members. According to this arrangement the work beam is slideable relative to the frame to reach essentially all damaged regions on the vehicle.

Further provided is a work beam adjustment for adjusting movement of the work beam transversely of the opposing support members as well as mounting means for mounting the work beam adjustment on the one support member in a manner such that the work beam adjustment is correspondingly slideable with the work beam along the structure. Therefore, regardless of the location of the work beam the adjustment is in proper position for effecting its reciprocal movement. With this arrangement the number of work beam adjustments only needs to correspond with the number of work beams and not the number of possible work beam locations.

With the frame straightening structure of the present invention, the slideable and adjustable angle work beams are set up to push or pull under, for example, full hydraulic power in a clear unobstructed work space at essentially any angle relative to both the vehicle and the frame of the structure.

Other benefits are further achieved due to the specific design of the present invention. For example, welding operations and the like must be carried out while the vehicle is on the structure and with the present invention there is increased operator access which enables convenient use of metal inert gas-type welding units having substantial hose lines and cables at the gun end making them awkward to work with in prior art arrangements having relatively limited access. However, in accordance with the present invention, this problem is substantially mitigated due to the increased working area and reduced interference provided by the structure. Furthermore, the operator of the welding operation will himself be more able to see what he is doing and allowed to angle the welding gun properly relative to the job due to the increased working space.

BRIEF DISCUSSION OF THE DRAWINGS

The above as well as other advantages and features of the present invention will be described in greater detail according to the detailed description of the preferred embodiments of the present invention in which:

FIG. 2 is an exploded perspective view of a portion of one of the frame side rails of the structure shown in FIG. 1.

FIG. 3 is an assembled end view of the side rail.

FIG. 4 is an assembled perspective view of the end of the side rail.

FIG. 4*a* is a perspective view showing a variation of the rail assembly of FIG. 4.

FIG. 4*b* is an enlarged partially cut-away perspective view of the variation of FIG. 4*a* when fully assembled.

Figure 1:
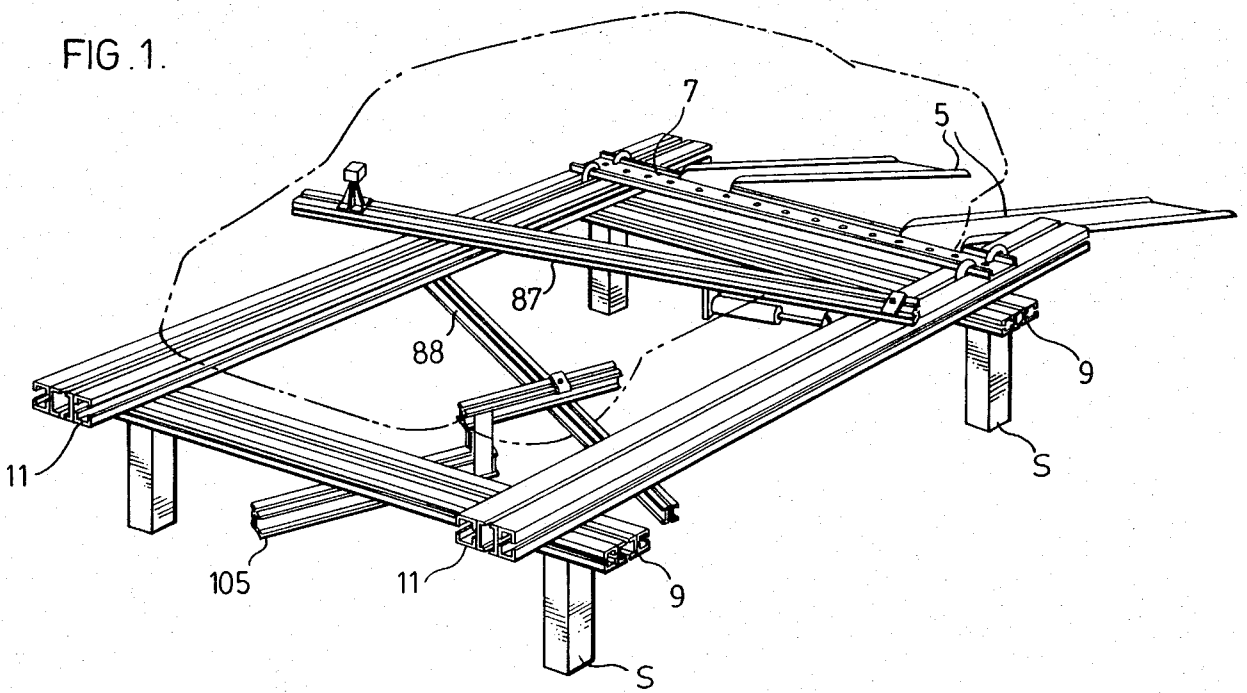
FIG. 1 is a top perspective view of an assembled automotive collision repair structure according to a preferred embodiment of the present invention.
Figure 5:
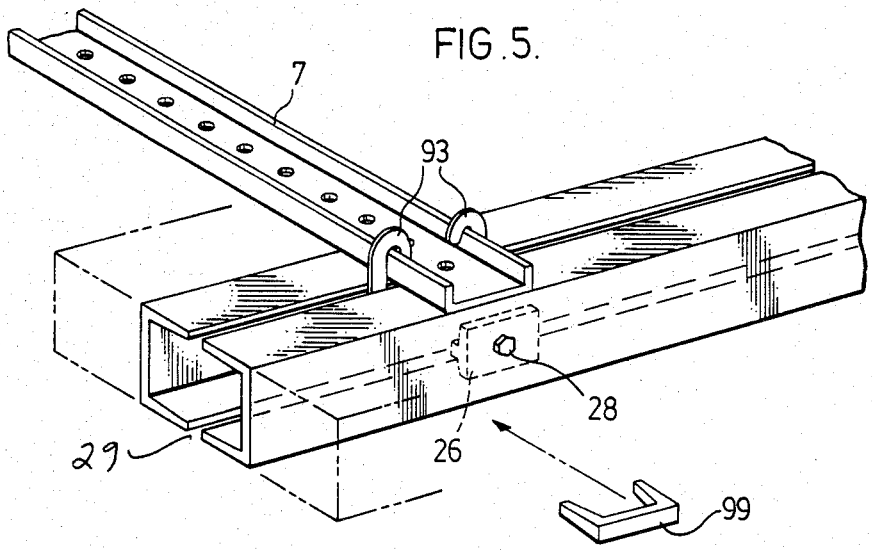

FIG. 5 is a top perspective view of a ramp support beam secured to one of the side rails for supporting the ramp shown in FIG. 1.

Figure 6:
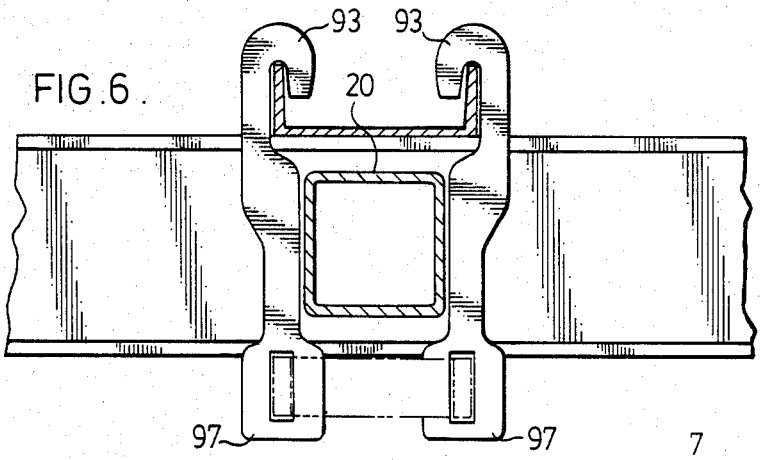

FIG. 6 is an end view of the ramp support beam with part of the frame rail being broken away to show the securing of the ramp support beam therein.

Figure 7:
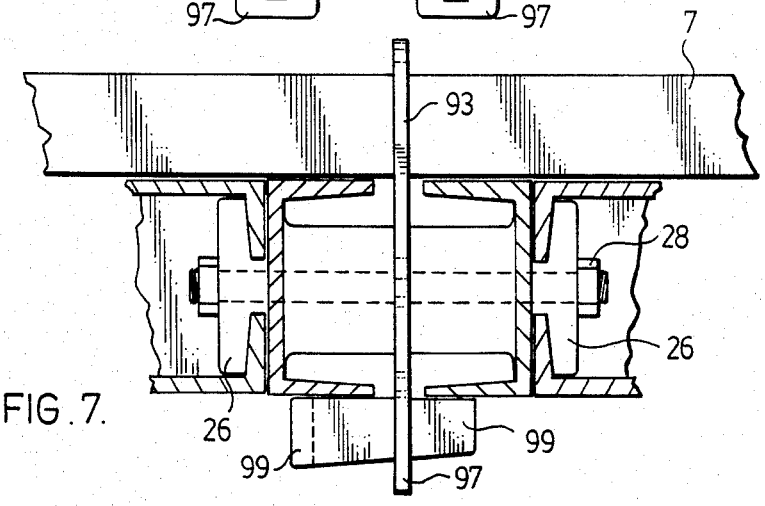

FIG. 7 is a sectional view looking along the frame rail at right angles to the ramp mounting beam.

Figure 8:
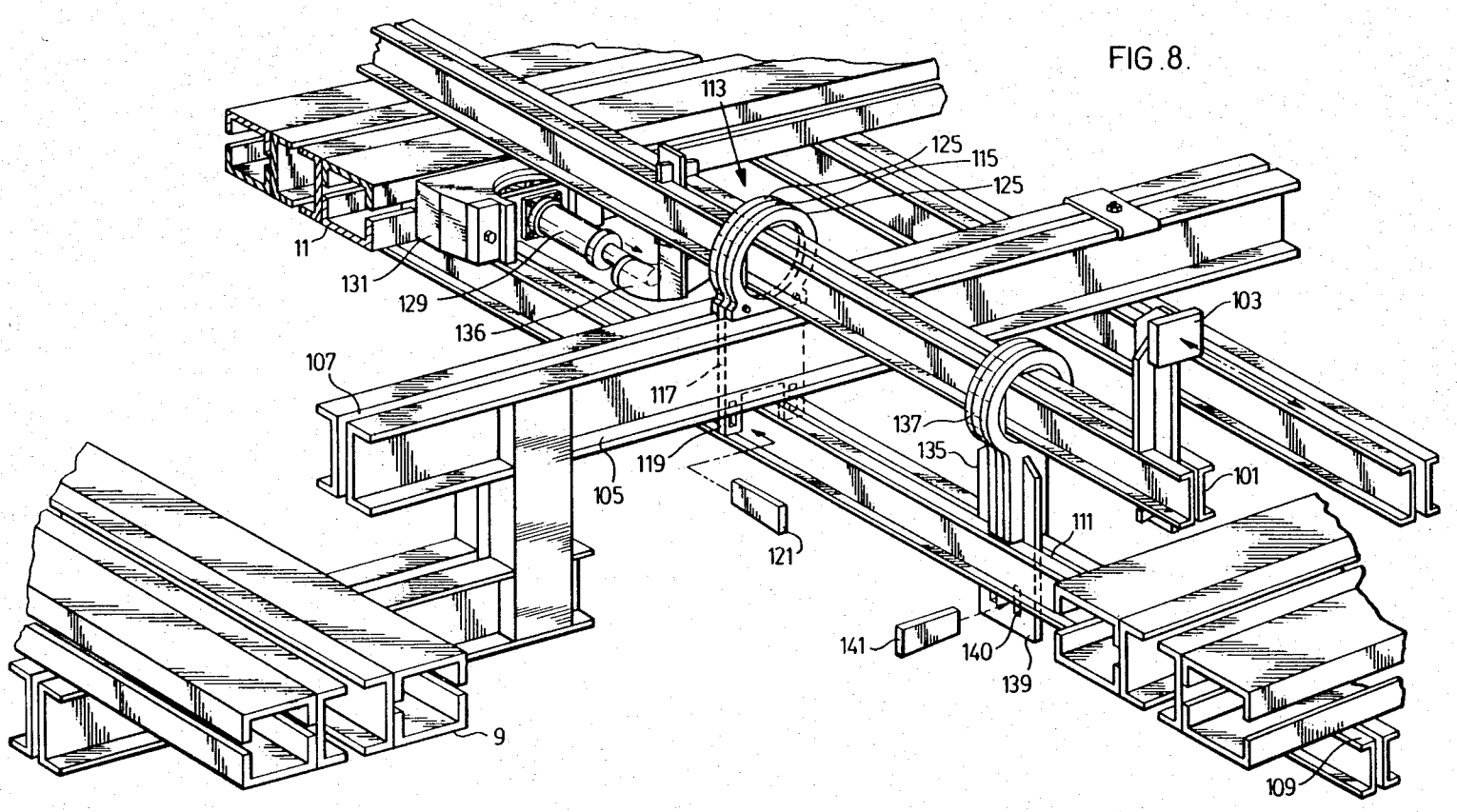

FIG. 8 is an enlarged perspective view showing the mounting of a transverse work beam to one of the frame side rails.

FIGS. 9 and 10 are sectional views through the work beam of FIG. 8 showing the work beam in different angled working positions.

FIG. 11 is an exploded perspective view of a yoke member for supporting the work beam of FIGS. 8 through 10.

Figure 12:
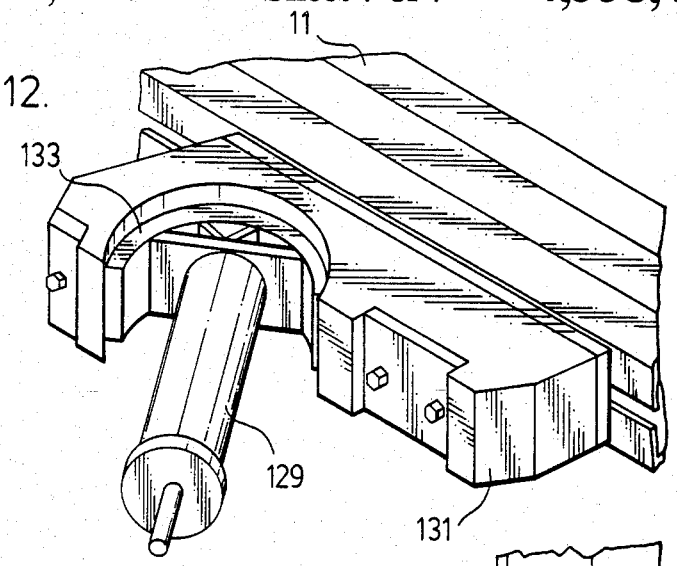
Figure 13:
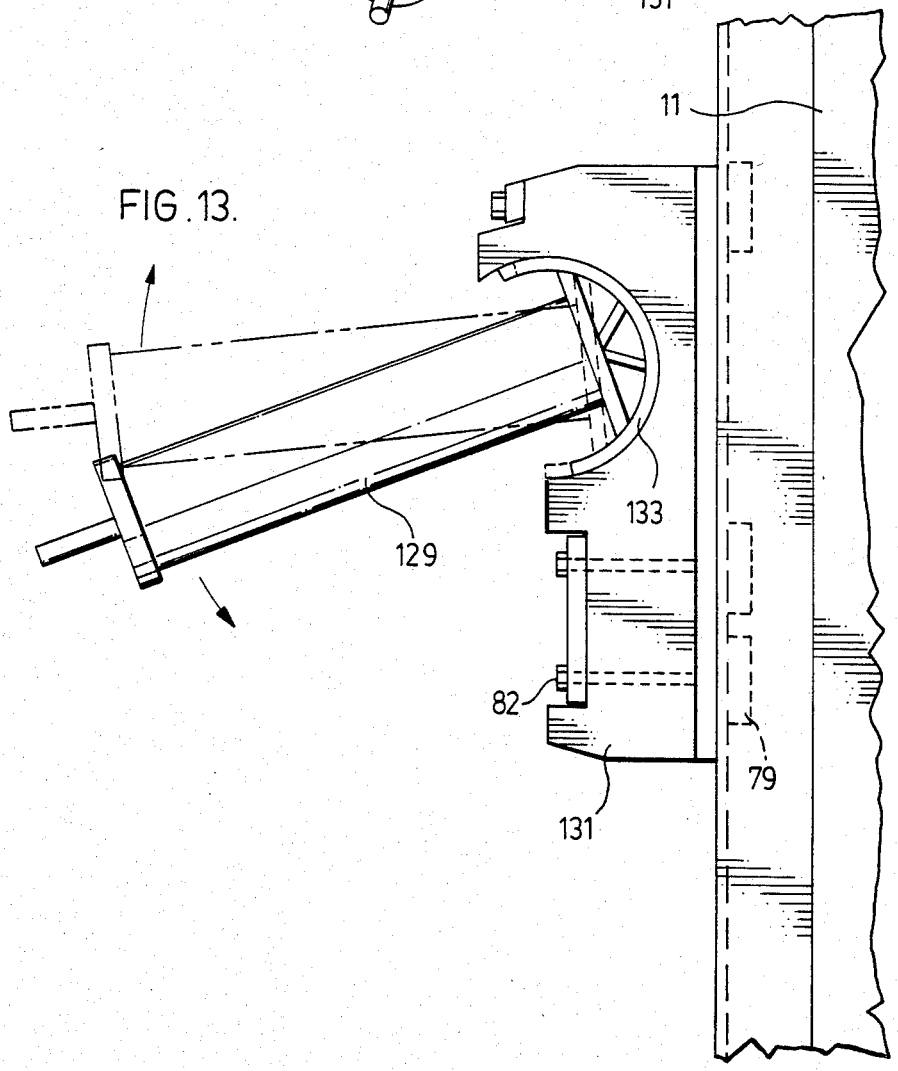

FIGS. 12 through 13 are top perspective and top plan views respectively of the mounting and the adjustment for controlling transverse adjustment of the work beam of FIG. 8.

DETAILED DESCRIPTION ACCORDING TO THE PREFERRED EMBODIMENTS OF THE PRESENT INVENTION

FIG. 1 shows an automotive collision repair structure generally indicated at 1. In accordance with the present invention, this structure is made of a plurality of components which are relatively light in weight with many of the components being portable and readily disassembled from the structure adding substantially to the overall benefits of the arrangement. More particularly, the structure includes a main frame comprising a pair of transverse support rails 9 and a pair of main longitudinal support rails 11. The main frame is raised to an elevated position by a plurality of upstanding support members generally indicated at S with a pair of ramp members 5 being mounted to the frame by a ramp mounting beam 7. Extending transversely across the longitudinal support rails 11 are a number of transverse work beams such as beams 87 and 88 mounted above and below the frame respectively for effecting automotive repairs across a vehicle frame. Extending longitudinally of the structure is a longitudinal stepped work beam 105 for working along the length of the vehicle.

The particular structure shown in the drawings is one which is adapted to take cars and light trucks and could, obviously, be beefed-up to accommodate heavier vehicles such as larger trucks and the like. Although it has not been shown in FIG. 1 the structure further includes a treadway on which the vehicle is to be located while the repairs are being effected. This treadway is typical of those found in the art where separable sections of the treadway are located over the length of the structure interiorly of the two main support members or rails 11.

FIGS. 2 through 4 show one preferred embodiment construction of the longitudinal support rails 11 with the transverse support rails having a similar construction. This particular construction enables the use of work beams, as well as controls for reciprocal movement of those work beams, which are slideable along the entire length or across the width of the structure. Accordingly, since the work beams and their controls are slideable, the structure of the present invention requires substantially fewer work beams than a conventional automotive repair device requiring many work beams which are located at fixed frame positions.

In the construction of FIGS. 2 through 4 each of the support rails 11 is formed from a plurality of channel members so as to form three longitudinally extending beams comprising an inner beam, a central beam and an outer beam. The inner beam comprises a pair of channel members 13 and 15, the central beam comprises a pair of channel members 17 and 19 and the outer beam comprises a pair of channel members 21 and 23. As is clearly shown in FIGS. 2 through 4, the channel members of the inner and outer beams are oriented so as to present horizontally exposed slots 25 and 31 respectively running along the entire length of the support rail. The channel members in the central beam are turned at 90 degrees to those in the inner and outer beams so as to present vertically presented slots 27 and 29 also running along the entire length of the support rails. As will also be seen in these figures, the channel construction makes each of the beams substantially hollow, having a number of benefits, including the overall light weight of each of the support rails.

The assembly of the channel rails to form an integrated unit is accomplished through a plurality of key members, two of which are shown at 51 and 63 in the drawings. More specifically, key member 51 includes a stem portion 53 and a head portion 57. The head portion 57 is located interiorly of the inner beam formed by channel members 13 and 15 and includes lugs or tits 59 and 61 which lock into small openings 37 and 39 respectively in the two channel members. The stem portion 53 of the key 51 is fitted through a side opening 33 in channel member 17 with the small tit 55 at the end of the stem located in opening 43 in channel member 19.

Key 63, which fits into the support rail from the other side, includes a head portion 69, which is locked in the outer beam formed from channel member 21 and 23 provided with openings 45 and 49 respectively for receiving lugs or tits 71 and 73 on the head of key 63. The stem 65 of key 63 fits through opening 41 in channel 19 with lug 67 of the stem fitting into the small opening 35 in channel 19.

Once the two keys are properly fitted into position, as shown in FIG. 3, the stems of the keys overlap one another. Located between the overlapping stems is a small butterfly plate 75 with the two stems being secured to this butterfly plate by arc welding or the like to secure the keys relative to one another and to lock all of the channel members in a fixed position, as shown in FIGS. 3 and 4.

FIGS. 4*a* and 4*b* show a somewhat modified construction for the support rails. According to this construction the channel members themselves are substantially the same as those shown in FIGS. 2 through 4 with channel members 13*a* and 15*a* forming the inner beam, channel members 17*a* and 19*a* forming the middle beam and channel members 21*a* and 23*a* forming the outer beam of the modified construction. However, this modified construction rather than using the key system described above for integrating of the beams, is provided with rectangular tubing sections which hold the various channel members together as a common support rail.

More particularly, both the inner and the outer beams are provided with a plurality of rectangular, tubular connectors 16 which are welded to the upper and lower channel members of the respective beams. The height of the tubular sections ensures that there is a spacing between the channel members in each of the beams to provide the inner and outer facing slots along the support rails. The width of each of the tubular sections is less than the distance across each of the beams to provide a sliding clearance for movement of the work beam along the length of the support rails as will be described later in detail.

The central beam of the support rail includes a plurality of rectangular, tubular sections 20 which are turned at 90 degrees to those found in the inner and outer beams so that the hollow region of the tubular section 20 is located in a horizontal rather than a vertical positioning. The tubular section is welded to the opposing inner faces of channel members 17*a* and 19*a* for integrating the central beam.

In order to secure the entire rail as a common unit, wedge plates 26 are fitted into the inner and outer beams on either side of channel members 17*a* and 19*a* which are drilled completely through to allow the fitting of a securing bolt 28 from one of the wedge pieces through both of the channel members 19*a* and 17*a* in the hollow of the tubular section and through the other of the wedge-shaped pieces. The bolt is then threaded tight to secure the three beams to one another.

In a preferred construction, the centre beam tubular sections 20 are spaced at about 36 inch intervals along the support rail while the inner and outer beam pieces are staggered relative to the centre beam spaces and at about 18 inch spacings along the inner and outer beams. This provides a staggered stress relief network along the entire support rail.

To further secure the three beams to one another, once tightly clamped in position they are welded together with intermittent bead techniques which neutralizes any heat-induced distortions which can occur along the support rail.

Although the assembly construction as described above relates specifically to the longitudinal support rails it is to be appreciated that these same construction techniques will be used in the transverse support rails of the frame. In addition, for purposes of securing the longitudinal and the transverse perimeter rails, interlocking shear plates are provided at the mounting ends of the rails, thereby integrating the entire frame as a single unit. This frame unit is then secured to the stand-up supports S, at the lower surface of the transverse perimeter rails and the upper flanges of the floor supports by means of cross welds.

It should be noted that securing of the frame and the upright supports is carried out only at flush surface areas and avoiding any tapered surfaces which might otherwise take away from the solid and rigid assembly of the frame structure as described above.

FIGS. 5 through 7 show the securing of the ramp support beam 7 to one of the support rails 11 with the securing of the ramp beam being identical at the other side of the structure.

The ramp beam 7 again has a channel construction which is turned in an upwardly facing positon, as clearly shown in FIGS. 5 and 6. Located along the length of the ramp beam are a plurality of openings which allow for the adjustment of the ramp members to different widths, relative to one another.

Extending up through slot 29 in the central beam of the rail support are a pair of hook members 93 which lock onto the channel construction of the ramp beam. These two hook members are located on opposing sides of one of the tubular sections 20 within the central beam. Each of the hook members has a wedge-receiving portion 97 at its lower end for receiving wedges 99 which, when driven into position tightly clamp the hook members onto the ramp mounting beam 7 with the tubular section 20 preventing the hook members and the ramp mounting beam from sliding along the length of the support rail.

As an additional safety factor, wedge-shaped members 26 are located to either side of the tubular section 20 with the channel members of the inner and outer beams to receive one of the bolts 28, passing beteen the two hook members 93 in the central beam. This provides a further reinforcing for the ramp mounting beam since even intermittent welds may break when subjected to torsional loads and combination pulls or pushes of the type of forces which the structure of the present invention is capable of handling. Furthermore, even though all hydraulic stressing is of a compressive nature on the frame rails, the through bolts help to counter any fly-apart tendencies when the beams are in either a bow-out or a bow-in condition.

As mentioned above, one of the main features of the present invention is the use of work beams which are adjustable to different work positions. The adjustments of these work beams can be accomplished in two manners, firstly the work beams are slideable relative to the perimeter of the main frame; secondly, each of the work beams is adjustable to different work angles either across or along the length of the frame. For example, as shown in FIG. 1, support rail 87 extends at something other than a 90 degree angle width wise across the structure while a second support rail 88 extends at another off 90 degree angle across the structure. In addition the longitudinal work beam 105 extends at an angle other than 90 degrees relative to the length of the structure. This ability to move the work beams to different transverse work angles, substantially increases the capacity of an individual work beam to reach otherwise inaccessible locations on the automotive vehicle body. It also substantially increases the efficiency of the work beams by reducing twist, lean and distortion in the power movements of the work beams. This is in contrast to prior art arrangements with fixed pivot tower arms requiring the use of massive steel to provide heavily built supporting structures since, as is the case with prior art structures, the base line of the tower is not in line with the pulling direction so that there is a power robbing distortion in the tower lineup. In fact, no amount of stiffening will counter this characteristic so that even the heavily built prior art structures do not overcome the problem. Furthermore, with combination hook-up and reaction forces, even the base frame of these prior art structures will tend to distort and in order for the towers to be effective, they must have pivot and perimeter contact at the base connection which is positionable to aim the lines of the base axis to correspond with the line of pull and in using heavy tower construction as is presently available, just maneuvering the beams is awkward.

In contrast, the structure of the present invention enables the use of light-weight portable and easily moveable towers which will only be needed for certain types of pulls. Additionally useful with the present invention are less bulky, bar standards adjustable in height for pulls lower than fender level. When working with the towers they can be positioned on any one of the sliding beams or in any position in the perimeter beam centre slot.

When numerous work beams are used, all of the beams need not extend in the same direction and in fact the two beams 87 and 88, shown in FIG. 1, extend in opposite directions. In the case of beam 87, which is used as a pusher beam, the one end of the beam is located at the support rail 11 on the right-hand side of the figure, extending above the structure, whereas work beam 88 is secured at the support rail 11 on the left-hand side of the figure and extending below the structure. The lower beam may, for example, be used as a puller beam fitted with hooks and chains and the like, to pull damage from the vehicular frame while the pusher beam 87, including the pusher member can be used to push on vehicular damage for purposes of straightening the frame and body of the vehicle. An adjustment in the form of a piston member 129 is used to apply pressure to work beam 87 once it is in the appropriate position and to push out the damage to the vehicle and again, in accordance with one of the main features of the present invention, this piston member is slideable along the support rail from which it is supported and movable to corresponding transverse angles with the work beam for applying the required pressure.

FIG. 3 shows the mounting of work beam 87 to the support rail. Here it will be seen that a large headed bolt 85 is fitted through both the body of the work beam and the longitudinally extending slot 29 of the central beam in the support rail. Fitted interiorly of this central support rail beam is a threaded plate 83 for receiving bolt 85 which, as will be appreciated, can easily be loosened to allow the work beam to be slid to a desired position, adjusted to the proper transverse angle and then barely tightened to effectively locate the work beam in the set working position.

As described above, the mounted end of the work beam contains the pressure or stressing unit for providing reciprocal motion of the work beam relative to the frame. The other free end of the beam is in contact with the vehicle damage area and is free to arc, relative to the pressure end of the beam resulting in a self-seeking, self-stabilizing type of pressure providing better repair due to the minimizing of any additional distortions which could be caused by the work beam if it were not self-seeking in its work position.

Once the beam has been moved to the desired work position it is then moved or reciprocated along its axis to apply the desired force. In the case of beam 87 the force applying positioning is controlled through piston 129 mounted by a cradle assembly to the support rail 11, as well shown in FIGS. 12 and 13. This cradle assembly comprises a mounting portion 131 and a rotatable coupling 133 which allows movement of the piston 129 to an angle corresponding to that of the work beam. The cradle assembly itself is, like the work beam, slideable and lockable along the support rail to an appropriate position for applying the required pressure on the support beam.

The piston arrangement described above is generally referred to in the industry as a pressure ram. According to the present invention the ram avoids the use of any globular or ball and socket connections which could result in very unstable jacking conditions or even allow the ram to kick out damaging the piston and hoses. In contrast the ram, as shown in the drawings includes nothing but flat contact surfaces so that any angling of the piston member is accomplished by angling the saddle base relative to the piston with the ram cylinder or piston remaining parallel to the work beam. On same trucks in which diamond correction is required, the frame may arc as much as 10 inches; therefore, the ram used on the base of the arcing beam requires maximum stability. Accordingly, rams in an underslung position may, for example, be caged for support and the drop of the ram adjusted to centre the ram position between the operating base and the jack stop.

FIG. 3 shows the mounting portion 131 of the cradle assembly being connected through the horizontally opening slot 25 of the inner rail beam formed by channel members 13 and 15 through a sliding block 79 having a threaded bolt portion 81 which extends through the mounting portion of the cradle assembly to receive a nut 82, as well shown in the drawings. A number of these mounting blocks may be provided for proper securing of the cradle assembly to the support rail and the nut and bolt securing arrangement allows the entire cradle assembly with the piston 129 to be slid along the support rail to a desired position and then locked at that position. As described above, the beams themselves include clearance to allow such sliding.

As will be clearly understood from the description above, the work beam itself is supported from the central beam of the support rail whereas the cradle assembly for the work beam adjustment piston is supported from the side beams of the support rail. In the arrangement described above, the support for the cradle assembly is provided at the inside beam but could, with minor adaptations, be equally as well supported at the outside beam and slideable therealong for use with, for example, a puller, as opposed to a pusher work beam.

It should be noted that the design emphasis for the structure of the present invention relates to the accessibility and the flexibility of the machine so that portable rather than fixed bracing is used. The location and angling of the bracing should be selected for maximum effect and should not interfere with the free arc of the beams. In fact, the beams themselves can be used as braces by simply wedging the jack stops against the opposite side of the frame. If separate bracing is used it should be located in the immediate range of the work area and similarly angled to the particular work beam in need of bracing.

Therefore the efficient layout of braces is at the choice and responsibility of the operator since the technique of bracing is just as important as the technique for straightening the frame of the vehicle. In the first type of bracing described above where the work beams are used themselves, ram stressing force is provided through the rack or frame. If the beams themselves are used to provide bracing alternating beams are set up in such a way as to counter one another so that the frame is in the neutral range. If, however, this type of set-up cannot be achieved then direct bracing is necessary. The bracing pressure can be coupled to any section of the opposite side of the frame and may be angled to correspond with the main pressure working beam to provide a balancing of forces within the frame which will substantially extend the life of the overall machine.

The description above relates specifically to the work beams extending across the width of the frame. It is to be appreciated that the longitudinally extending work beams such as beam 105 are also adjustable to different working positions by sliding the mounted end of the longitudinal work beam relative to the transverse perimeter rail or support of the frame and thereafter adjusting the particular angle of the longitudinal work beam. Although the mounted end of the longitudinal work beam has not been shown in the drawings it may be set up identically to that described with respect to the work beams extending across the width of the structure.

As mentioned above, the repair of damage to a vehicle can be accomplished by either pushing or pulling on the damaged region. According to the present invention the pushing is self-stabilizing since the beam is free to arc at its working end. The pulling usually brings the work into a narrow set pattern or direction depending on the pull angle. To some operators this type of repair method may not seem overly important, however, when the body sections are heavily crushed a smoothing pull should be made on the pulling beam to control the spreading of the crushed sheet metal.

In the case of a sway or diamond correction, a pushing technique will result in better line-up with the damage which can be repaired in a much shorter time through pushing. Again, this takes advantage of the self-stabilizing reaction of the beam as well as the memory or the energy that is stored up in the body during manufacture of the vehicle. Either a tight sway or a tight diamond condition may only be repaired with diagonal pushing beams acting at 90 degrees to the line of distortion on the vehicle which can be accomplished with the beams of the present invention. In contrast when the beam cannot be properly lined up there may be further crushing or in fact, tearing away of the damaged area.

FIGS. 8 through 11 show a further feature of the present invention in which a transverse work beam 101 is adjustable to different working angles by rotating the work beam about its longitudinal axis to vary the verticle angle positioning of pusher member 103, mounted to the work beam for effecting repairs to different areas on a vehicle. This is particularly handy in cases where there may be an interfering body part directly above the work beam which can be cleared by simply adjusting the angle of the pusher member as shown in FIGS. 9 and 10 of the drawings.

As will be seen in the FIG. 8 arrangement, additional support for work beam 101 is provided through the longitudinally extending work beam 105. This longitudinally extending work beam is mounted at one end to the base of the transverse perimeter rail and includes a stepped-down portion that is free to clear beneath the frame of the structure at its forward end. Mounted atop the longitudinal work beam is a yoke member generally indicated at 113, fitted over and providing support to work beam 101 in its different working angles. Provided beneath the longitudinally extending work beam is a lower transverse support beam 109 aligned with work beam 101 and secured to both longitudinal beam 105 through yoke member 113 and also to work beam 101 through a connecting member 135.

It should be noted, according to the versatility of the present invention, the same work beam adjustment set-up of piston 129 and its cradle assembly may be used for the transverse control of both beam 87, as described above and beam 101, as shown in FIG. 8. It will be noted that beam 101 includes an elongated arcuate shaped plate portion 136 to receive piston 129 at different angles to which beam 101 is rotated about its axis.

Beam 101 can in fact be rotated to the point that the pusher plate on standard 103 approaches or even clears past a 45 degree angle from the vertical thereby clearing beyond plate 136. In such a case an adjustable bar standard can be used in place of stop 136 and still receive pressure from the press angle base 131 of pusher member 129. It should again be noted that with further tilting of the standard 103 the press base saddle insert will additionally be angled but the contact of the jack itself still remains in parallel with the beam with the centre axis of the jack being at right angles to its base, as well as to plate 136 or a longer bar standard to maintain an efficient pressure line-up and to substantially increase the working capacity of the arrangement.

The yoke 113, for supporting work beam 101 from beam 105 includes a head portion 115, fitted with an insert 123, having a rectangular opening for slideably receiving work beam 101. Insert 123 is rotatable relative to the head of the yoke to allow beam 101 to be rotated abouts its longitudinal axis to the desired working angle. Once the work beam has been properly adjusted, it is locked in its angular position by locking wedges as explained below which effectively locks any further rotation of the insert within the head of the yoke. Lateral movement of the insert within the head of the yoke is prevented by means of a pair of plate portions 125 secured at either side of the yoke head in shear action against centre plate 115.

Extending downwardly from the head of the yoke is a flattened body portion 117 which fits completely through slot 107 running along the length of support beam 105. Extending downwardly from the base of the flattened body portion are a pair of legs 119 which fit to either side of transverse support beam 109. These legs include a pair of wedge receiving openings into which wedges 121 are driven to effectively lock the yoke relative to the intermediate support beam 105 and to tighten insert 123 and lock work beam 101 in its angular position by pulling downwardly on plate 115 and applying downward pressure on insert 123 to wedge the insert against plates 125, also fitted over the insert and supported against downward movement by beam 105, as shown in FIG. 8.

Connecting member 135 is similar to yoke member 113 in that it includes a head portion 137 fitted with a rotatable insert for fitting over work beam 101 as well as a flattened body portion 139 which extends through the slot 111 in transverse support beam 109. Provided at the lower end of the connecting member 135 is a slot 140 for receiving a wedge 141 to secure the connecting member relative to the transverse support beam.

As will be seen from the above, the structure of the present invention is capable of effecting repairs to an automotive vehicle through the use of a plurality of work beams each of which is moveable to different working angles including both transverse angles relative to the main support rails as well as rotatable angles of the work beam itself about its longitudinal axis. Furthermore, each of the individual work beams, with the number of these beams being substantially less than that of a conventional arrangement, is slideable to different working positions along the length of the structure to further increase the working capacity and efficiency of an individual beam. Accordingly with the structure of the present invention essentially any given area of the vehicle can be stressed in any desired precise and exact angle in substantially any and all directions. In addition the individual work beams can easily be disassembled and laid flat on the structure to use as a loading beam of the vehicle treadway or to ease removal and storage of the structure. To this end it should be noted that there are no permanent braces which allows freedom of access within the structure. Any braces or bracing methods that are used will be at the operator's discretion who can simply locate the beams where needed and lock up the beam and the perimeter rails with appropriate anchors. Diagonal beams may be used in a similar manner using angle presses anchoring at either the inside or the outside of the perimeter rails as described above. Even 45 degree bracing can be used with the angle press and saddle arrangement described above on the transverse and longitudinal perimeter beams and jacked in between.

From the safety standpoint the structure of the present invention is extremely stable in nature since, for example, in a push set-up where the beams are self-seeking there is essentially no chance of jack-knifing of the beams.

The machine of the present invention will be particularly beneficial to those machine shops already in possession of 6 inch rack frames and 5 inch working beams who wish to update their systems since the structure of the present invention is particularly adapted to accommodate many of the existing attachments with substantial cost savings.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A structure for use in automotive collision repair comprising a support frame of peripheral support members, at least one work beam extending across and moveable transversely of opposing ones of said support members, work beam mounting means for mounting one end of said work beam to one of said support members with the other end of the work beam supported at the opposing support member such that said work beam is slideable relative to said support frame of said structure and adjustable to different working angles relative to said support members, a work beam adjustment for adjusting movement of said work beam transversely of the support members, and mounting means for mounting said work beam adjustment on said one of said support members in a manner such that said work beam adjustment is correspondingly slideable with said work beam along said structure, said work beam adjustment comprising a piston member for applying pressure on said work beam and said mounting means for said work beam adjustment comprising a saddle assembly slideable along said one of said support members and having a rotatable coupling for receiving said piston which is rotatable to different transverse angles with respect to said work beam.

2. A structure as claimed in claim 1 wherein each of said support members comprises a plurality of integrated channel members presenting upwardly and sidewardly opening elongated slots for respectively receiving said work beam mounting means and said mounting means for said work beam adjustment.

3. A structure as claimed in claim 2 wherein said channel members are keyed to one another.

4. A structure as claimed in claim 1 wherein said one of said support members comprises an inner, an outer, and a central beam, each of said inner, outer and central beams being generally hollow and each beam having a slot therealong with said beams being turned at 90 degrees to one another such that the slots in said inner and outer beams are presented horizontally and the slot in said central beam is presented vertically of said one of said support members, said work beam mounting means being secured through the slot of said central beam and said mounting means for said work beam adjustment being secured through the slot in one of said inner and outer beams.

5. A structure as claimed in claim 4 including a plurality of work beams at different locations along said structure, said plurality of work beams including upper and lower work beams supported at said central beam and including work beam adjustments mounted at said inner and outer beams.

6. A structure as claimed in claim 1 wherein said work beam is rotatable about its longitudinal axis for adjustment to different working angles and wherein said structure includes a longitudinally extending intermediate beam between said support members and positioned to support said work beam at the different working angles and coupling means for coupling said work beam to said intermediate beam at generally 90 degrees to one another, said coupling means being adapted to receive said work beam in all of its different working angles with a single position coupling to said intermediate beam.

7. A structure as claimed in claim 6 wherein said coupling means for coupling said work beam to said intermediate beam comprises a yoke member having a generally circular opening therethrough and a yoke insert for slideably mounting on said work beam and rotatably fitting into the circular opening in said yoke member.

8. A structure as claimed in claim 7 wherein said intermediate beam includes a slot running lengthwise thereof and said yoke member includes a flattened body portion for fitting into said slot of said intermediate beam.

9. A structure as claimed in claim 7 including a transverse support beam aligned with said work beam at generally right angles to and on the other side of said intermediate beam from said work beam, said yoke member including spaced apart leg portions extending from said body portion for locking onto said transverse support beam.

10. A structure as claimed in claim 9 including a connecting member for connecting said transverse work beam directly to said transverse support beam, said connecting member comprising a head portion fitted with a rotatable head portion insert for slideably mounting on said work beam and a leg portion for fitting into a slot in said transverse support beam.

11. A structure as claimed in claim 10 including means for locking said yoke member insert and said head portion insert against rotation at a set position.

12. A structure as claimed in claim 1 wherein said work beam is rotatable about its longitudinal axis to different working angles and including a piston contact member extending from said work beam for receiving said piston member in such different working angles.

13. A structure as claimed in claim 12 wherein said piston contact member has an elongated arcuate configuration.

14. A structure as claimed in claim 1 including a portable ramp removably secured through a ramp mounting beam to longitudinal ones of said support members, said mounting beam having a plurality of ramp receiving positions for varying width of said ramp.

15. A structure as claimed in claim 14 wherein said ramp comprises a pair of independent ramp members adjustable to different widths on said ramp mounting beam, each of the longitudinal support members having longitudinal slots therethrough and said structure including ramp mounting members for fitting into said slots and locking said ramp mounting beam to said longitudinal support members.

16. A structure as claimed in claim 15 wherein said ramp mounting beam comprises an inverted channel beam and wherein said ramp mounting members comprise hook members for hooking onto said channel beam, said hook members having a wedge receiving region for receiving wedge means to lock said hook members into said slots in said longitudinal support members.

17. A structure as claimed in claim 1 including a plurality of work beams at different locations on said structure.

18. A structure as claimed in claim 1 wherein said at least one work beam extends width wise across said support frame.

19. A structure as claimed in claim 1 wherein said at least one work beam extends lengthwise across said support frame.

20. A structure as claimed in claim 1 including work beams extending both widthwise and lengthwise of said support frame.

* * * * *